US008539680B2

(12) United States Patent
Strauss

(10) Patent No.: US 8,539,680 B2
(45) Date of Patent: Sep. 24, 2013

(54) UTILITY KNIFE

(75) Inventor: Ralf Strauss, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 424 days.

(21) Appl. No.: 12/858,013

(22) Filed: Aug. 17, 2010

(65) Prior Publication Data

US 2012/0042521 A1 Feb. 23, 2012

(51) Int. Cl.
*B26B 3/06* (2006.01)
*B26B 1/00* (2006.01)

(52) U.S. Cl.
USPC ..... 30/329; 30/162; 30/339

(58) Field of Classification Search
USPC ..... 30/161–163, 124–125, 2, 329–330, 30/332–333, 335, 337, 339
See application file for complete search history.

(56) References Cited

U.S. PATENT DOCUMENTS

| | | | | |
|---|---|---|---|---|
| 3,078,572 | A * | 2/1963 | Everton | 30/333 |
| 4,068,375 | A * | 1/1978 | Rathbun et al. | 30/125 |
| 4,575,940 | A * | 3/1986 | Wenzel | 30/335 |
| 4,586,256 | A | 5/1986 | Weimann | |
| 4,604,805 | A * | 8/1986 | Krieger | 30/330 |
| 5,022,156 | A * | 6/1991 | Kallens et al. | 30/125 |
| 5,025,558 | A | 6/1991 | Gilbert | |
| D352,881 | S | 11/1994 | Schmidt | |
| 5,864,952 | A * | 2/1999 | Chung | 30/162 |
| D426,133 | S * | 6/2000 | Degen et al. | D8/99 |
| 6,192,589 | B1 | 2/2001 | Martone et al. | |
| 6,223,439 | B1 | 5/2001 | Wonderley | |
| D453,461 | S | 2/2002 | Chen | |
| D462,250 | S | 9/2002 | Ping | |
| 6,532,670 | B1 * | 3/2003 | Berns | 30/339 |
| 6,574,872 | B2 * | 6/2003 | Roberts et al. | 30/330 |
| 6,752,054 | B2 | 6/2004 | Knight | |
| 6,802,126 | B2 * | 10/2004 | Huang | 30/162 |
| 6,829,827 | B2 | 12/2004 | Tseng | |
| 6,845,561 | B2 * | 1/2005 | Timson | 30/125 |
| 6,865,816 | B1 * | 3/2005 | Zajdel | 30/330 |
| D508,839 | S | 8/2005 | Brown et al. | |
| D510,010 | S | 9/2005 | Brown et al. | |
| D511,288 | S | 11/2005 | Brown et al. | |
| D511,447 | S | 11/2005 | Brown et al. | |
| 6,971,178 | B2 * | 12/2005 | Rowlay | 30/162 |
| D520,327 | S | 5/2006 | Gist et al. | |
| 7,100,285 | B1 * | 9/2006 | Huang | 30/162 |

(Continued)

OTHER PUBLICATIONS

U.S. Appl. No. 12/858,019, filed Aug. 17, 2010.

(Continued)

*Primary Examiner* — Ghassem Alie
*Assistant Examiner* — Bharat C Patel
(74) *Attorney, Agent, or Firm* — Dennis J. Williamson; Moore & Van Allen PLLC

(57) ABSTRACT

A utility knife includes a first housing portion carrying one of a strike plate and a sliding nut assembly and a second housing portion carrying the other one of the strike plate and the sliding nut assembly. The sliding nut assembly includes a rotatable screw and a sliding nut. The sliding nut is movable between a first position where the sliding nut is positioned behind the strike plate and a second position where the sliding nut is positioned spaced from the strike plate. When the sliding nut is in the first position, the sliding nut engages the strike plate upon rotation of the screw to draw the first housing portion toward the second housing portion.

19 Claims, 5 Drawing Sheets

(56) References Cited

U.S. PATENT DOCUMENTS

| | | | | |
|---|---|---|---|---|
| 7,131,204 | B2 * | 11/2006 | Brown et al. | 30/162 |
| 7,186,067 | B2 * | 3/2007 | Leblanc | 411/409 |
| 7,316,070 | B2 * | 1/2008 | Green | 30/162 |
| 7,647,702 | B2 * | 1/2010 | Polei | 30/162 |
| 7,814,664 | B2 | 10/2010 | LeBlanc et al. | |
| 2007/0068003 | A1 * | 3/2007 | Schmidt | 30/162 |

OTHER PUBLICATIONS

U.S. Appl. No. 12/858,023, filed Aug. 17, 2010.

* cited by examiner

UTILITY KNIFE

The invention relates generally to utility knives and more particularly to a utility knife with an improved housing assembly.

BACKGROUND OF THE INVENTION

Utility knives typically comprise a knife housing that is typically provided with an aperture that receives a blade such that the blade extends from the housing. A user can grasp the housing and use the blade for cutting or slicing. When the blade becomes worn, dull or breaks the housing may be opened to allow replacement of the blade.

SUMMARY OF THE INVENTION

The utility knife comprises a first housing portion carrying a strike plate and a second housing portion carrying a sliding nut assembly comprising a rotatable screw and a sliding nut. The sliding nut engages the strike plate upon rotation of the screw to draw the first housing portion toward the second housing portion.

The first housing portion may comprise a first perimeter edge that abuts a second coextensive perimeter edge on the second housing portion. A raised lip may extend from the first perimeter edge toward the interior of the first housing portion and be received in a recess formed in the second perimeter edge of the second housing portion. A first supporting surface may be provided on the first housing portion and a second supporting surface may be provided on the second housing portion, where the first and second supporting surfaces comprise generally planar surfaces that face one another and are spaced from one another approximately the thickness of a blade. A magnet may be formed in one of the first supporting surface and the second supporting surface.

The front edges of the first housing portion and second housing portion may be formed with overlapping locking mechanisms that engage one another to prevent the first housing portion from separating from the second housing portion. The sliding nut assembly may be located at a generally central location of the first and second housing portions. The strike plate may comprise a flat, generally C-shaped plate member fixed to the first housing portion that includes a recessed area for receiving the sliding nut. The sliding nut assembly may comprise a rotating screw that includes a head that is disposed on the outside of the second housing portion. The screw may include a screw thread that threadably engages the sliding nut. The sliding nut may be prevented from rotating relative to the screw but is allowed to travel along the longitudinal axis of the screw when the screw is rotated. The sliding nut may include a projection that engages a stop to prevent the sliding nut from rotating. When the housing is in the closed position the periphery of the sliding nut may be positioned behind the strike plate such that rotation of the screw pulls the sliding nut toward the strike plate until the sliding nut is in tight engagement with the strike plate.

A blade holder may be located in the housing, where the blade holder comprises a wireform clamp having one end secured to the housing and a second free end where the wireform is bent such that the free end acts as a spring clamp to hold the blades. The blade holder further comprises a support that is angled relative to the housing wall such that the blades are supported at an angle in the housing.

DETAILED DESCRIPTION OF EMBODIMENTS OF THE INVENTION

Figure 1:
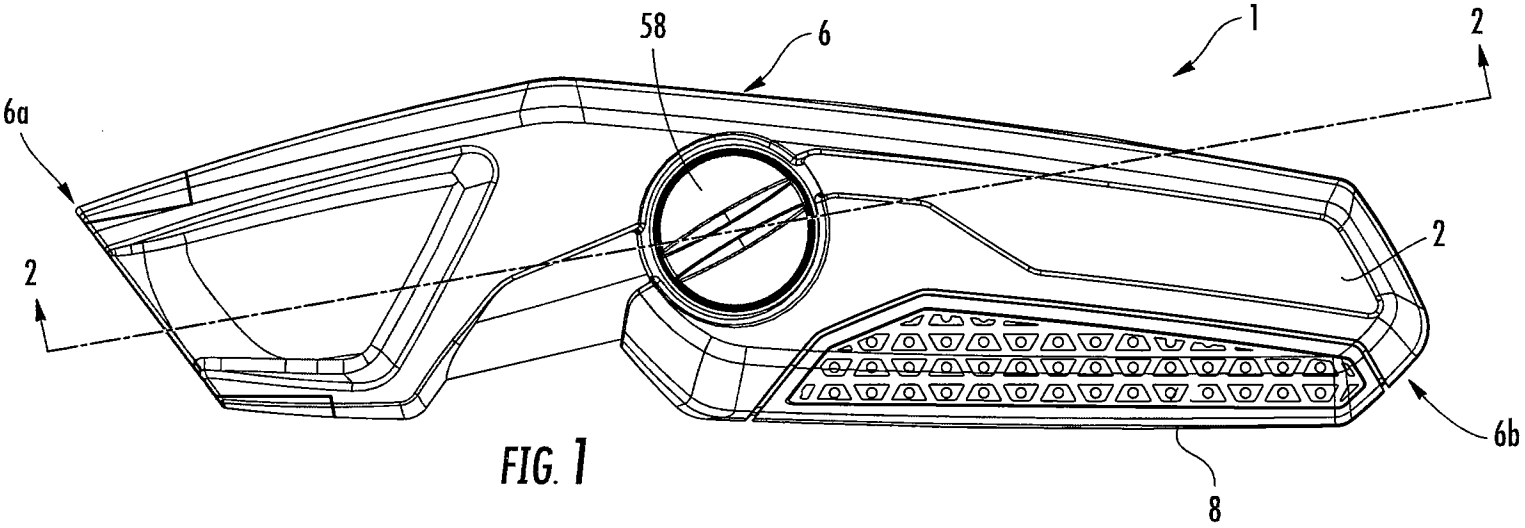
FIG. 1 is a front view of an embodiment of the utility knife of the invention in the closed position.

The utility knife is shown generally at 1 in the figures and comprises a first housing portion 2 and a second housing portion 4. The housing portions are releasably interlocked with one another to form the completed knife housing 6. The knife housing 6 has a generally elongated profile that may be comfortably grasped by a user's hand with the front end or nose 6*a* of the knife extending from the user's hand. Toward the rear end or butt 6*b* of the housing 6 a hand grip 8 is formed that may be comfortably gripped.

The first housing portion 2 comprises a perimeter edge 10 that abuts a coextensive perimeter edge 12 on the second housing portion 4 in the assembled housing 6 to define a generally open interior. Near the rear end 6*b* the first housing portion 2 a raised projection 14 is formed that extends from the perimeter edge 10 toward the interior of the first housing portion 2. Raised projection 14 extends into a recess 16 formed in the perimeter edge 12 of the second housing portion 4 to align the housing portions fix the position of the housing portions together as will hereinafter be described.

Formed near the front end 6*a* of the housing 6 is a blade support structure comprising a first blade supporting surface 20 formed on the first housing portion 2 and a second blade supporting surface 22 formed on the second housing portion 4. The surfaces 20 and 22 comprise generally planar surfaces that face one another when the housing 6 is assembled and are spaced from one another approximately the thickness of a blade 24 such that the blade is supported between the surfaces. The surfaces 22 and 24 are spaced from one another such that a slotted aperture 18 is created at the nose 6*a* of the housing 6 through which the blade 24 extends during use. A magnet 26 may be formed in one of the surfaces, shown on surface 22, to hold the blade 24 in position during assembly and disassembly of the housing 6.

Located adjacent the top edge of the support surface 20 is a pin 30 that extends from the housing portion 2 toward the housing portion 4 and is dimensioned such that the pin 30 spans the gap between the housing portions. The pin 30 slides into engagement with a groove 32 formed in the top edge of the opposing surface 22 during assembly of the housing 6. The pin 30 engages one of a plurality of notches 24*a* formed in the blade 24 such that when the blade is positioned in the assembled housing 6 the blade is retained in the housing by pin 30 and cannot be removed without separating the housing portions 2 and 4. The notch 24*a* engaged by the pin 30 may be selected to adjust the length of the blade extending from the housing 6.

The front edges of the housing portions 2 and 4 are formed with overlapping locking mechanisms. The locking mechanisms engage one another to prevent the housing portions 2 and 4 from separating from one another at the nose 6*a* due to the forces exerted on the housing by the blade during use of the knife. Housing portion 2 includes an engagement element 40 that extends across the plane a-a where the edges 10 and 12 abut. Engagement element 40 defines a bearing surface 40*a* that faces the housing portion 2. Housing portion 4 includes a mating engagement element 42 that includes a bearing surface 42*a* that faces opposite to bearing surface 40*a*. To assemble the housing 6 the housing portion 2 is slid into engagement with the housing portion 4 as shown by arrow b such that bearing surface 40*a* of engagement element 40 is disposed behind bearing surface 42*a* of engagement element 42. Because of the mechanical interlocking of the engagement elements 40 and 42 the nose 6*a* cannot be pried apart. A similar structure is formed on the bottom front edges of housing portions 2 and 4. Housing portion 2 includes an engagement element 46 that extends across the plane a-a. Plane a-a is the plane defined by the perimeter edges 10 and 12 in the assembled housing. Engagement element 46 defines a bearing surface 46*a* that faces the housing portion 2. Housing portion 4 includes a mating engagement element 48 that includes a bearing surface 48*a* that faces opposite to bearing surface 46*a*. To assemble the housing 6 the housing portion 2 is slid into engagement with the housing portion 4 such that engagement element 46 is disposed behind engagement element 48. The engagement of these elements prevents the nose of the knife from being pried open by forces exerted by the blade on the housing during use of the knife.

To lock the housing portion 2 to the housing portion 4 a sliding nut assembly is provided on one of the housing portions that engages a fixed strike plate on the other housing portion. In the illustrated embodiment the strike plate 50 is formed on the housing portion 4 at a generally central location. The strike plate 50 comprises a flat, generally C-shaped plate member fixed to the housing portion. The strike plate 50 includes a recessed area 55 for receiving the sliding nut as will be described. The strike plate 50 is secured to the housing portion such that it is spaced from the housing wall 2*d*. In the illustrated embodiment the plate 50 is fixed to the housing portion by screws 52 although any mechanism for connecting the plate to the housing may be used.

The sliding nut assembly 54 is mounted to the other housing 4 opposite to the strike plate 50. The sliding nut assembly 54 comprises a rotating screw 56 that extends through a hole 57 formed in the wall 2*c* of the housing portion 2. Rotating screw 56 has a head 58 that is located on the outside of the housing portion 4 where it may be manipulated by a user to rotate the screw 56. The head 58 is larger than the hole 57. The head 58 may include raised areas or other topography to facilitate the user's grip on the head. The shaft 62 of screw 56 extends through hole 57 and includes a threaded portion 68 with screw threads that threadably engage sliding nut 66 and an unthreaded bearing surface 70 that rotates in hole 57. A C-clamp 72 is snap fit into an annular groove on the shaft 62 on the back side of the housing portion 4 to retain the screw 56 in the housing portion 4.

The threaded portion 68 of the screw 56 engages a mating threaded 74 hole in the sliding nut 66. The sliding nut 66 is prevented from rotating relative to the screw 56 but is allowed to travel along the longitudinal axis of the screw as the screw is rotated. In the illustrated embodiment the sliding nut 66 includes a projection 76 that is trapped between a pair of stops 78 such that the sliding nut 66 is prevent from rotating. The screw 56 is dimensioned such that the sliding nut 66 may be positioned behind the strike plate 50, between the strike plate 50 and the back wall 2*d* of the housing portion 4, when the screw 56 is in its unloosened position. In the unloosened position the screw 56 is rotated until the sliding nut 66 is positioned at or near the distal end of the screw. The distal end of the screw may be formed with an enlarged flange or a deformed or unthreaded area 69 to prevent the sliding nut from being completely unthreaded from the screw.

Figure 2:
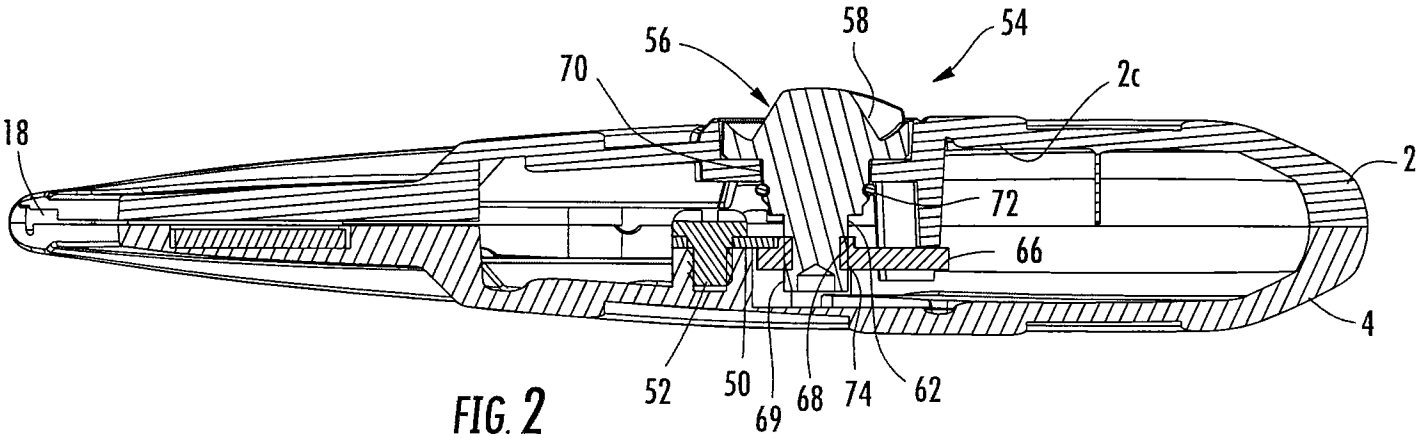
FIG. 2 is a section view taken along line 2-2 of FIG. 1.

When the housing is in the closed position, shown in FIGS. 1 and 2, the periphery of the sliding nut 66 is positioned behind the strike plate 50. When the screw 56 is rotated clockwise the sliding nut 66 is pulled toward the strike plate 50 until the sliding nut 66 is in tight engagement with the strike plate 50. As the screw 56 is tightened engagement of the sliding nut 66 with the strike plate 50 draws the first housing portion 2 toward the second housing portion 4 to clamp the housing portions together. To open the housing 6 the screw 56 is loosened to disengage the sliding nut 66 from the strike plate 50. The housing portions 2 and 4 are slid relative to one another such that the sliding nut 66 is slid from behind the strike plate 50 and the housing portions 2 and 4 separated from one another.

A blade holder 80 is also provided in the housing. The blade holder 80 comprises a wireform clamp 84 having one end 84*a* secured to housing portion 4 such as by screw 82 and a second free end 84*b*. The wireform is bent such that the free end 84*b* acts as a spring clamp to hold the blades. The wireform is slightly deformed when a blade or blades are located behind the wireform such that a clamping force is created on the blades to hold the blades in position. A platform may be provided against which that blades may be pressed by the wireform clamp. In the present embodiment the platform comprises a pair of supports 86 spaced such that the blades span the supports. Each support has a first end 86*a* and a second end 86*b* where the second end 86*b* is disposed further away from the wall 2*d* than the first end 86*a* such that the blades are supported at an angle in the housing with the top ends of the blade projecting away from the housing wall 2*d*. By angling the support surfaces 86 relative to wall 2*d* a space is provided between the top of the blades and the housing wall 2*d* that allows the user's fingers to get behind the blades. The blades may be removed by grasping the top edge of the blades and slightly deforming the wireform 84 to release the blades.

Operation of the utility knife of the invention will be described with reference to the figures. Assume that the knife is in the assembled condition with the first housing portion 2 and the second housing portion 2 coupled together by the engagement of the sliding nut 66 with the strike plate 50 as shown in FIGS. 1 and 2. To open the housing, the screw 56 is rotated in a loosening direction, typically counter-clockwise as viewed in FIG. 1 (block 901). As the screw 56 rotates, the engagement of the screw 56 with the sliding nut 66 moves the sliding nut away from the strike plate 50 (block 902). The engagement of extension 76 with stops 78 prevents the sliding nut 66 from rotating with the screw 56. As a result, the sliding nut 66 is forced to traverse the length of the screw toward the distal end of the screw.

Figure 3:
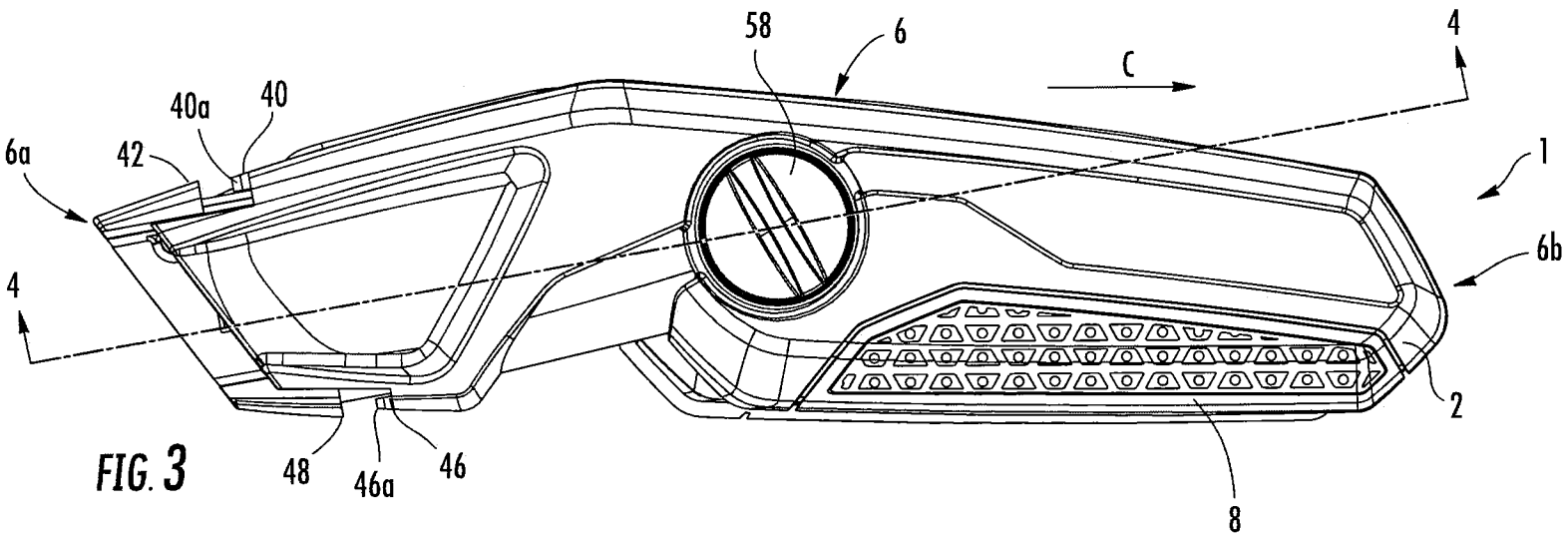
FIG. 3 is a front view of the utility knife of FIG. 1 in an open position.
Figure 4:
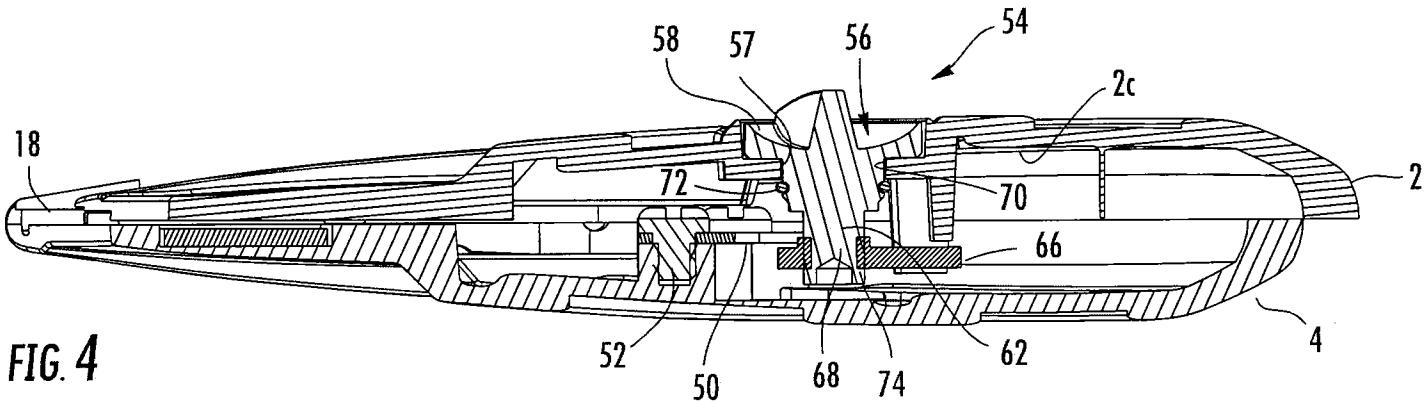
FIG. 4 is a section view taken along line 4-4 of FIG. 3.
Figure 5:
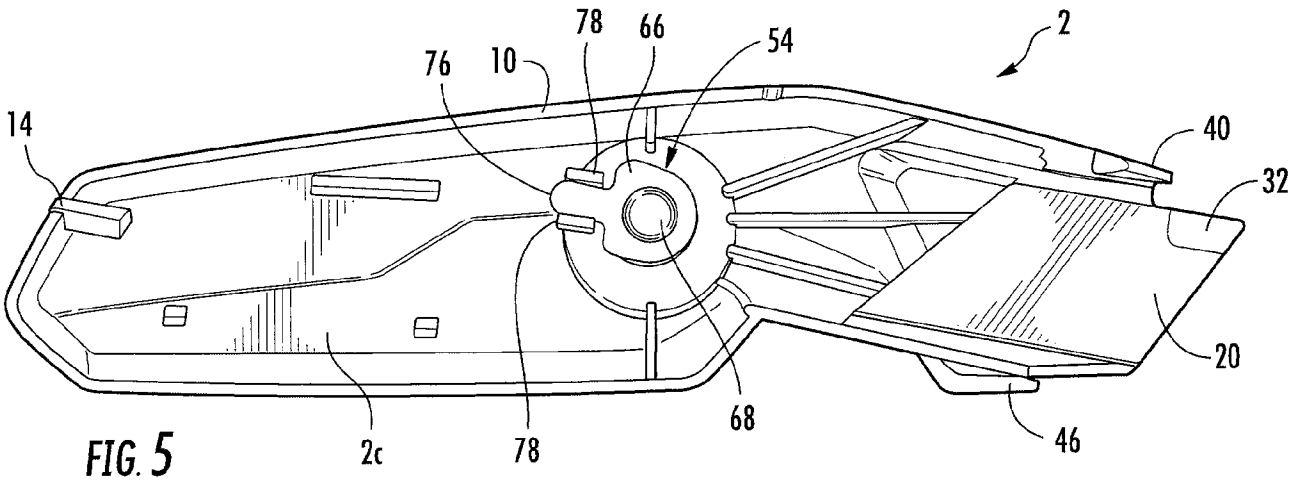
FIG. 5 is a front view of the inside of a first housing portion of the utility knife of FIG. 1.
Figure 6:
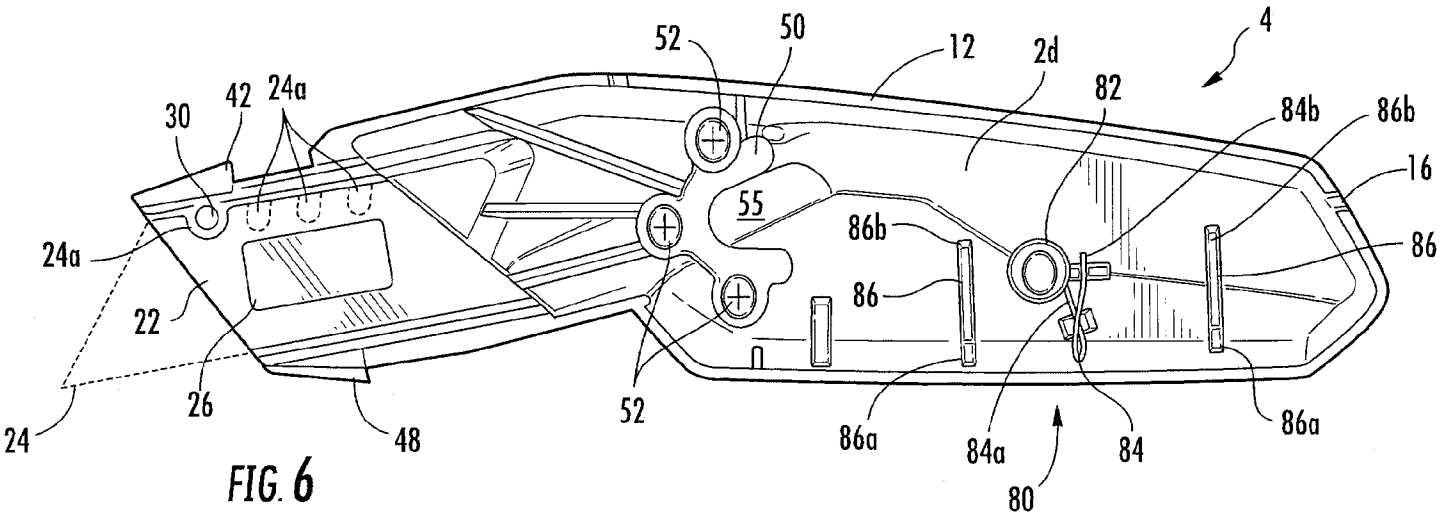
FIG. 6 is a front view of the inside of a second housing portion of the utility knife of FIG. 1.
Figure 7A:
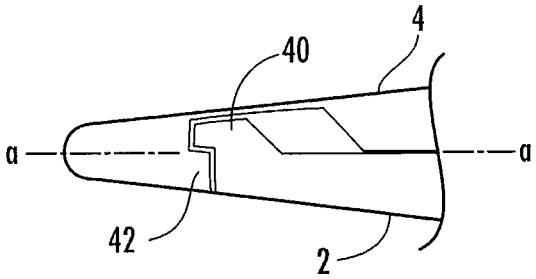
FIG. 7*a* shows an engagement structure between the housing portions in a closed position.
Figure 7B:
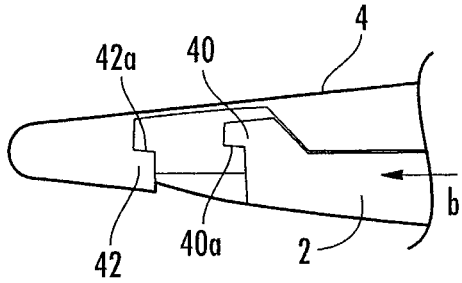
FIG. 7*b* shows the engagement structure of FIG. 7*a* between the housing portions in an open position.
Figure 8A:
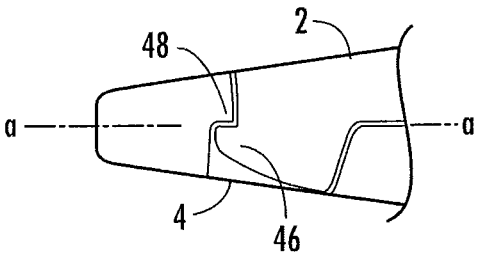
FIG. 8*a* shows a second engagement structure between the housing portions in a closed position.
Figure 8B:
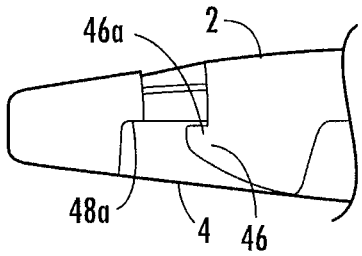
FIG. 8*b* shows the second engagement structure of FIG. 8*a* between the housing portions in an open position.
Figure 9:
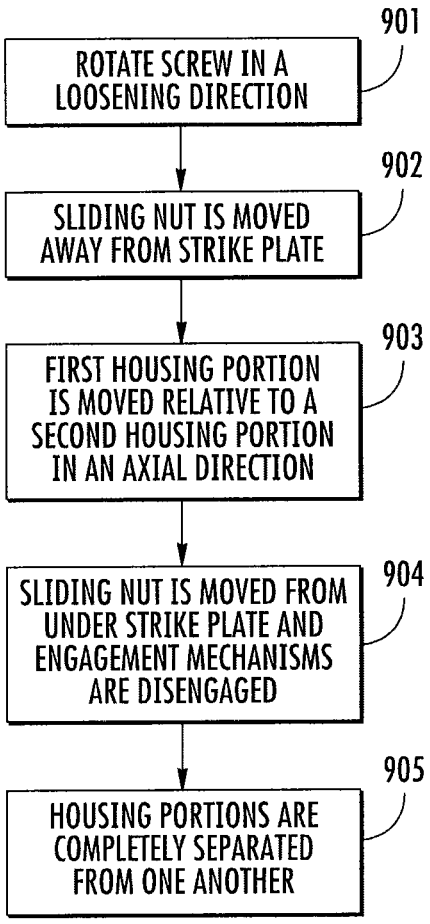
FIGS. 9 and 10 are block diagrams illustrating methods of operating the knife.
Figure 10:
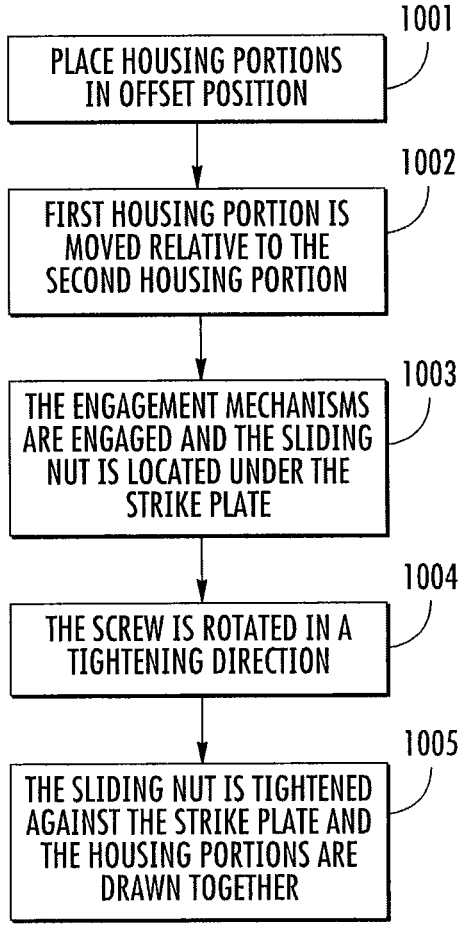

As the sliding nut 66 moves away from the strike plate 50 the clamping force is released. Once the sliding nut 66 releases the strike plate 50, the housing portion 2 is slid relative to the housing portion 2 as shown in FIGS. 3 and 4 (block 903). The housing portion 2 is slid in the axial direction of arrow c toward the rear of the housing 6. As the housing portion 2 is slid rearward, the sliding nut 66 is moved out from under the strike plate 50 such that the strike plate is not positioned over the sliding nut. Simultaneously, the engagement mechanisms are moved from the engaging positions shown in FIGS. 7*a* and 8*a* to the non-engaged positions shown in FIGS. 7*b* and 8*b* (block 904). Protrusion 14 slides in groove 16 to guide the housing portion 2 from the position of FIG. 1 to the position of FIG. 3. Once the housing portion is moved to the release position shown in FIG. 3, the housing portions can be completely separated from one another by pulling the housing portions 2 and 4 away from one another (block 905). The user can access the replacement blades to remove, replace and/or reposition the blade.

The housing 6 may be reassembled by reversing the steps described above. The user places the housing portions 2 and 4 together in the offset position shown in FIGS. 3 and 4 (block 1001). In this position the sliding nut 66 is disposed adjacent to, but not behind, the strike plate and the engagement mechanisms are in the disengaged positions shown in FIGS. 7*b* and 8*b* and the protrusion 14 is in groove 16. The housing portion 2 is slid to the position shown in FIGS. 1 and 2 where the edges 10 and 12 of the housing portions 2 and 4 are coextensive (block 1002). The engagement mechanisms move to the engaged position of FIGS. 7*b* and 8*b* and the sliding engagement of protrusion 14 with groove 16 allows the housing portion 2 to the proper position. As the housing portion 2 is slid relative to housing portion 4, the sliding nut 66 moves to be located under the strike plate 50 (block 1003).

The screw 56 is rotated in a tightening direction, clockwise as viewed in FIG. 1, to move the sliding nut 66 toward the strike plate 50 (block 1004). The sliding nut 66 is continued to be rotated to tighten the sliding nut 66 against the strike plate 50 and to draw the housing portions 2 and 4 together (block 1005). Once the sliding nut is tightly engaged with the strike plate the assembly of the utility is complete.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A utility knife comprising:

a first housing portion slidably movable relative to a second housing portion between a first position and a second position;

one of the a first housing portion and the second housing portion carrying a strike plate such that the strike plate is spaced from a wall of the one of the first housing portion and the second housing portion;

another one of the first housing portion and the second housing portion carrying a sliding nut assembly comprising a rotatable screw and said sliding nut constrained for movement along the axis of the screw, said sliding nut being positioned between the strike plate and the wall of the one of the first housing portion and the second housing portion when the first housing portion and the second housing portion are in the first position, and the sliding nut moving away from the strike plate when the first housing portion and the second housing portion are in the second position; the sliding nut, when the first housing portion and the second housing portion are in the first position, engaging the strike plate upon rotation of the screw to draw the first housing portion toward the second housing portion.

2. The utility knife of claim 1 wherein the first housing portion comprises a first perimeter edge that abuts a second coextensive perimeter edge on the second housing portion, wherein a raised lip extends from the first perimeter edge toward the interior of the first housing portion, said raised lip being received in a recess formed in the second perimeter edge of the second housing portion.

3. The utility knife of claim 1 further comprising a first supporting surface on the first housing portion and a second supporting surface on the second housing portion, said first and second supporting surfaces face one another and are spaced from one another to retain a blade therebetween.

4. The utility knife of claim 3 wherein a magnet is on one of the first supporting surface or the second supporting surface.

5. The utility knife of claim 3 wherein a pin extends from one of the first housing portion or the second housing portion toward the other one of the first housing portion or the second housing portion, said pin engaging a groove formed in the other one of the first housing portion or the second housing portion for engaging a notch formed in the blade.

6. The utility knife of claim 1 wherein a front edge of the first housing portion and a front edge of the second housing portion are formed with overlapping locking mechanisms that mechanically engage one another to prevent the first housing portion from separating from the second housing portion.

7. The utility knife of claim 1 wherein the sliding nut assembly is located at a generally central location of the first and second housing portions.

8. The utility knife of claim 1 wherein the strike plate comprises a flat, generally C-shaped plate.

9. The utility knife of claim 8 wherein the strike plate includes a recessed area for receiving the sliding nut.

10. The utility knife of claim 1 wherein the sliding nut assembly is mounted to the another one of the first housing portion and the second housing portion opposite to the strike plate.

11. The utility knife of claim 1 wherein the screw extends through the another one of the first housing portion and the second housing portion.

12. The utility knife of claim 11 wherein the screw has a head that is disposed on the outside of the another one of the first housing portion and second housing portion.

13. The utility knife of claim 11 wherein the screw includes a screw thread that threadably engages the sliding nut.

14. The utility knife of claim 11 wherein the sliding nut is prevented from rotating relative to the screw but is allowed to travel along a longitudinal axis of the screw when the screw is rotated.

15. The utility knife of claim 14 wherein the sliding nut includes a projection that engages a stop to prevent the sliding nut from rotating.

16. The utility knife of claim 1 wherein the sliding nut is positioned behind the strike plate.

17. A utility knife comprising:

a first housing portion having a first front edge and a second housing portion having a second front edge, the first housing portion slidably movable relative to the second housing portion between a closed position and a second position;

one of the first housing portion and the second housing portion carrying a strike plate such that the strike plate is spaced from a wall of the one of the first housing portion and the second housing portion;

another one of the first housing portion and the second housing portion carrying a sliding nut assembly comprising a rotatable screw and said sliding nut constrained for movement along the axis of the screw, said sliding nut positioned between the strike plate and the wall of the one of the first housing portion and the second housing portion; the sliding nut engaging the strike plate upon rotation of the screw to draw the first housing portion toward the second housing portion;

the first front edge comprising a first engagement element and the second front edge comprising a second engagement element where the first engagement element engages the second engagement element when the first housing portion is slid into engagement with the second housing portion in the closed position to prevent the first front edge from being separated from the second front edge;

when the first housing portion and the second housing portion are in the closed position the sliding nut is positioned behind the strike plate such that rotation of the screw pulls the sliding nut toward the strike plate until the sliding nut is in tight engagement with the strike plate.

18. The utility knife of claim 1 wherein a blade holder is located in the housing, said blade holder comprising a wireform clamp having one end secured to one of the first housing portion or second housing portion and a second free end where the wireform is bent such that the free end acts as a spring clamp to hold at least one blade.

19. The utility knife of claim 18 wherein the blade holder further comprises a support disposed at an angle relative to the housing such that the at least one blade is supported at an angle in the housing.

* * * * *